United States Patent [19]

Virr

[11] Patent Number: 5,005,528

[45] Date of Patent: Apr. 9, 1991

[54] BUBBLING FLUID BED BOILER WITH RECYCLE

[75] Inventor: Michael J. Virr, Fairfield, Conn.

[73] Assignee: Tampella Keeler Inc., Williamsport, Pa.

[21] Appl. No.: 508,841

[22] Filed: Apr. 12, 1990

[51] Int. Cl.[5] ..... F23D 1/00; F23G 5/00

[52] U.S. Cl. ..... 122/4 D; 110/245

[58] Field of Search ..... 110/245; 122/4 D

[56] References Cited

U.S. PATENT DOCUMENTS

| | | | |
|---|---|---|---|
| 3,625,164 | 12/1971 | Spector | 110/1 J |
| 4,165,717 | 8/1979 | Reh et al. | 122/4 D |
| 4,301,771 | 11/1981 | Jukkola et al. | 122/4 D |
| 4,528,945 | 7/1985 | Virr et al. | 122/4 D |
| 4,646,637 | 3/1987 | Cloots | 110/245 |
| 4,676,177 | 6/1987 | Engstrom | 110/245 |
| 4,708,067 | 11/1987 | Narisoko et al. | 110/245 |
| 4,740,216 | 4/1988 | Allard | 122/4 D |
| 4,823,740 | 4/1989 | Ohshita et al. | 122/4 D |

OTHER PUBLICATIONS

Leon and McCoy, "Archer Daniels Midland Conversion to Coal", Presented at the First International Conf. on CFR, Nov. 18-20, 1985, Canada.

L. Reh, "Fluidized Bed Processing", Chemical Eng. Progress, vol. 67, No. 2, pp. 58-63 (Feb. 1971).

*Primary Examiner*—Henry C. Yuen

*Attorney, Agent, or Firm*—Ailes, Ohlandt & Greeley

[57] ABSTRACT

A bubbling fluid bed steam generator comprising: a reactor chamber having a lower combustion region and a freeboard region; heat exchange means for the circulation of a coolant disposed substantially throughout the freeboard region and along the walls of the reactor chamber; discharge conduit disposed near the top of the reactor chamber for the discharge of flue gas containing entrained solid particles therein; a particle separator connected to the discharge conduit for separating the solid particles from the discharged flue gas, the solid particles being returned to the lower combustion region of the reactor chamber via a recycle port; means for introducing a carbonaceous material to the lower combustion region of the reactor chamber; primary inlet means for introducing a fluidizing gas disposed at the bottom of the reactor chamber; and secondary inlet means for introducing a fluidizing gas disposed above the recycle port, wherein the improvement is characterized by: the lower combustion region of the reactor chamber comprising a combustion zone and at least one heat transfer zone, the heat transfer zone having heat exchange means disposed therein.

13 Claims, 4 Drawing Sheets

BUBBLING FLUID BED BOILER WITH RECYCLE

The present invention relates to the burning of carbonaceous material, such as coal, wood, petroleum coke and other combustibles, in a bubbling fluid bed with recycle having heat exchangers disposed therein for the generation of steam. It is primarily directed to a bubbling fluid bed boiler structure with recycle which is capable of controlling the combustion process and reducing erosion of the heat exchange tubes and other internal surfaces of the boiler.

BACKGROUND OF THE INVENTION

The use of bubbling fluidized bed and circulating fluidized bed systems in the burning of carbonaceous materials to generate steam from heat exchangers disposed within fluidizing reactors is well documented throughout the literature. The steam is used for electric power generation, process heat, space heating, or other purposes.

A typical bubbling fluidized bed system is described in U.S. Pat. No. 4,301,771 (Jukkola et al.). Such systems generally include an air distribution chamber (usually called a windbox), a bubbling bed furnace, and a convection bank. The windbox receives air for fluidization of the feed material and distributes it uniformly throughout the bottom of the reactor chamber. The reactor chamber consists of a bubbling bed in the lower section and a freeboard in the upper section, all encased in a water-cooled membrane wall. The membrane wall may provide a part or all of the required heat transfer surface area for heat recovery. Additional heat transfer surface area, if necessary, can be provided by in-bed tubes. The gases exhausted from the reactor chamber enter a convection bank for further recovery of sensible heat contained in the gas and the entrained solids. Some of the entrained solids ma be captured in the convection bank and returned to the reactor chamber primarily for enhanced sorbent utilization and bed particle size control.

The bubbling bed process has some similarities to the circulating fluidized bed process, such as the use of inert bed material and the fluidization of the bed with air. That is, fluidizing air is introduced to the bottom of the bubbling bed and agitates the inert solids to create turbulent motion of the bed material. Air, upon being introduced through small orifice holes, creates small bubbles. The bubbles coalesce to bigger bubbles and rise through the inert bed due to buoyancy forces. The bubbles explode at the surface of the bed and splash the bed particles. Some of the splashed particles are elutriated and entrained in an upward flow of the moving gas stream. Relatively low gas velocity during the operation limits the amount of entrained solids. Because of the limited quantity of entrained solids in the freeboard there is a sudden change in solid concentrations across the surface of the bed. As a result, the bubbling or dense bed can be clearly distinguished from the freeboard due to the discontinuity in solid density gradients.

Fuel is introduced to the bubbling bed where it is combusted with sufficient amount of air introduced at the bottom of the bed. Most of the burning takes place in the bed or its immediate vicinity. Upon being entrained in the up flowing gas stream, however, unburned combustibles tend to escape the system without further burning. Heat transfer takes place in both the bubbling bed and in the freeboard area during combustion. A higher heat transfer rate is experienced in the bubbling bed because of extensive contact between solids and heat transfer surfaces, caused by the turbulent motion of the bed. The bed is maintained at a constant temperature during the operation owing to an extremely high heat reservoir of the bed. However, in the freeboard gas temperatures decrease along the height of the freeboard. In any cross-section of the freeboard the rate of heat transfer is higher than the rate of heat supplied or generated in the section. Therefore, the gas is cooled as it moves upward. The gas temperature at the outlet of the freeboard can be 300° to 400° F. lower than the bed temperature.

Some of the disadvantages associated with the bubbling bed process are: relatively small amount of heat transfer occurs in the freeboard region, the flue gas cools down as it traverses the freeboard region resulting in higher carbon monoxide emission, all of the combustion air is introduced at the bottom of the bed, and reduced combustion efficiency due to high carbon monoxide emission.

In order to overcome the disadvantages and inefficiencies of the bubbling fluidized bed process, the circulating fluidized bed process was developed. Circulating fluidized bed systems involve a two phase gas-solids process which promotes solids entrainment within the up flowing gas stream in the reactor chamber and then recycles the solids back into the reactor chamber with a high rate of solids circulation. The rate of solids circulation in the circulating fluidized bed process is about 50 times that of a bubbling bed process. Moreover, circulating fluidized bed systems typically use elongated reaction chambers which increase solids residence time, thus increasing carbon combustion efficiency, increasing heat transfer and decreasing carbon monoxide emission levels.

Various examples of known circulating fluid bed systems are described in U.S. Pat. No. 4,165,717 (Reh et al.) and U.S. Pat. No. 3,625,164 (Spector), and an article by A. M. Leon and D. E. McCoy, presented at the First International Conference on Circulating Fluidized Beds, Halifax, Nova Scotia, Canada (Nov. 18–20, 1985), entitled "Archer Daniels Midland Conversion to Coal".

Of particular interest is the Leon et al. article which involves the use of circulating fluid bed technology to generate steam from the burning of carbonaceous material. It discloses a circulating fluidized bed boiler which utilizes both a dense or "bubbling bed" and a dilute "fast" bed. The bubbling bed is at the bottom of the combustor with the dilute phase above. The operation with both a dense and dilute phase is achieved by permitting some of the combustion air to bypass the dense bed and enter at the bottom of the dilute phase. The dense bed and the dilute phase are accomplished by passing some of the combustion air around the dense bed. The bypassed or secondary air enters above the dense bed at various levels.

The present inventor has discovered that the circulating fluidized bed boiler has a number of disadvantages which can be classified into the following categories, i.e., control and erosion.

The problem of control arises when the circulating fluidized bed boiler is used to burn coal or coal wastes. During the burning of coal or coal wastes the temperature and excess air in the combustor must be maintained at specific values in order for the $SO_x$, $NO_x$ and CO emissions to remain satisfactory during low loads. That is, it is not acceptable when utilizing the conventional circulating fluidized bed boilers to deviate from predetermined values of temperature and excess air once the load factor drops to below 70%.

The second disadvantage which arises during commercial operation of conventional boilers is severe erosion of the boiler's heat exchange tubes, especially those tubes which line the sidewalls and roof of the combustor. It is believed that the erosion is caused by the high velocities necessary to achieve satisfactory heat transfer. It has been observed that some tubes can wear away and fail after only 1,000 hours of operation, particularly those tubes located in the roof and corners of the combustor. Various palative methods have been proposed to combat erosion, such as, fins, metal spray, studs and covering with refractory (see U.S. Pat. No. 4,714,049).

The present inventor has developed a unique bubbling fluid bed boiler with recycle which incorporates the advantages of both the circulating fluid bed and bubbling fluid bed systems, while overcoming the operational control and heat exchange tube erosion problems associated with those conventional systems. The present invention overcomes the aforementioned disadvantages by designing a circulating fluid bed boiler which includes a reactor chamber with a lower combustion region comprising a plurality of fluid bed zones having internal heat exchange means disposed within at least some of the zones. The multiple fluid bed zones are disposed in the dense or bubbling bed of the reactor chamber and are capable of controlling emission and reducing tube erosion, while maintaining satisfactory heat transfer levels.

Additional advantages of the present invention shall become apparent as described below.

SUMMARY OF THE INVENTION

A bubbling fluid bed steam generator comprising: a reactor chamber having a lower combustion region and a freeboard region; heat exchange means for the circulation of a coolant disposed substantially throughout the freeboard region of the reactor chamber; discharge conduit disposed near the top of the reactor chamber for the discharge of flue gas containing entrained solid particles therein; a particle separator connected to the discharge conduit for separating the solid particles from the discharged flue gas, the solid particles being returned to the lower combustion region of the reactor chamber via a recycle port; means for introducing a carbonaceous material to the lower combustion region of the reactor chamber; primary inlet means for introducing a fluidizing gas disposed at the bottom of the reactor chamber; and secondary inlet means for introducing a fluidizing gas disposed above the recycle port, wherein the improvement is characterized by: the lower combustion region of the reactor chamber comprising a combustion zone and at least one heat transfer zone, the heat transfer zone having heat exchange means disposed therein.

Preferably, the combustion zone is disposed between a first heat transfer zone and a second heat transfer zone. The zones are formed by a plurality of internal wall members; one internal wall member being disposed between the first heat transfer zone and the combustion zone, and the other internal wall member being disposed between the second heat transfer zone and the combustion zone. The internal wall members are positioned within the lower combustion region such that an underflow channel or weir is formed between the lower end of the internal wall members and the air distribution plate of the primary inlet means. Heat exchange means are disposed within each heat transfer zone allowing for high heat transfer due to the dense bed in those zones. The heat exchange tubes are positioned substantially horizontal from the front to the back of the reactor chamber.

The unique design and operation of the dense bed zones allows for the circulation of solid particles up the center of the reactor chamber, down the sidewalls into the heat transfer zones, and under the internal wall members into the combustion zone. The control of the combustor is such that by controlling the level of fluidizing gas introduced to the heat transfer zones the combustion zone may be maintained at the approximate optimum operating temperature so that the limestone reaction with the sulfur, and formation of $NO_x$ and CO is optimized during low loads.

The present invention may also include many additional features which shall be further described below.

DESCRIPTION OF THE PREFERRED EMBODIMENTS

The bubbling fluidized bed boiler of the present invention comprises a reactor chamber provided with water-cooled membrane walls. The lower combustion region of the reactor chamber, above the air distribution plate, is divided into a plurality of zones by interior wall members which may be water-cooled. One zone is a combustion zone having no internal reactor structures to limit the free flow of gas and suspended particles through the zone.

At least one other zone is a heat transfer zone in which heat exchange tubes extend into and through the zone to assure intimate contact between the tubes, gas and suspended particles; thereby obtaining maximum heat transfer.

Below the air distribution plate there is provided a windbox which is partitioned to form air chambers corresponding to the various zones located in the lower combustion region of the reactor chamber. Each of the air chambers is provided with an inlet port so that air can be individually supplied to each air chamber in volume appropriate to the function of the respective zone.

Thus, the combustion zone is supplied with large volume of air or fluidizing gas to produce a condition in the zone of high turbulence and low density which promotes rapid and efficient combustion. The air is supplied to the heat transfer zone or zones in a substantially lesser volume than to the combustion zone. The fluidized bed in a heat transfer zone is characterized by relatively high density and low turbulence. With a fluidized bed of high density contacting the heat exchange tubes, optimum heat transfer can be approached. At the same time, the low turbulence in the zone reduces the erosive effect of the fluidized bed on the heat exchange tubes and other internal structures of the reactor.

The internal wall members in the reactor chamber are of limited vertical extent, so that while the separate zones operate with quite different conditions as isolated by the internal wall members, above those internal wall members the gaseous and particulate flowing from the several zones merge and relatively uniform conditions of temperature and turbulence prevail. In this freeboard region of the reactor chamber, combustion continues with heat removed and utilized as steam through the membrane wall and by superheater or economizer in the exhaust passage to the stack.

Figure 1:
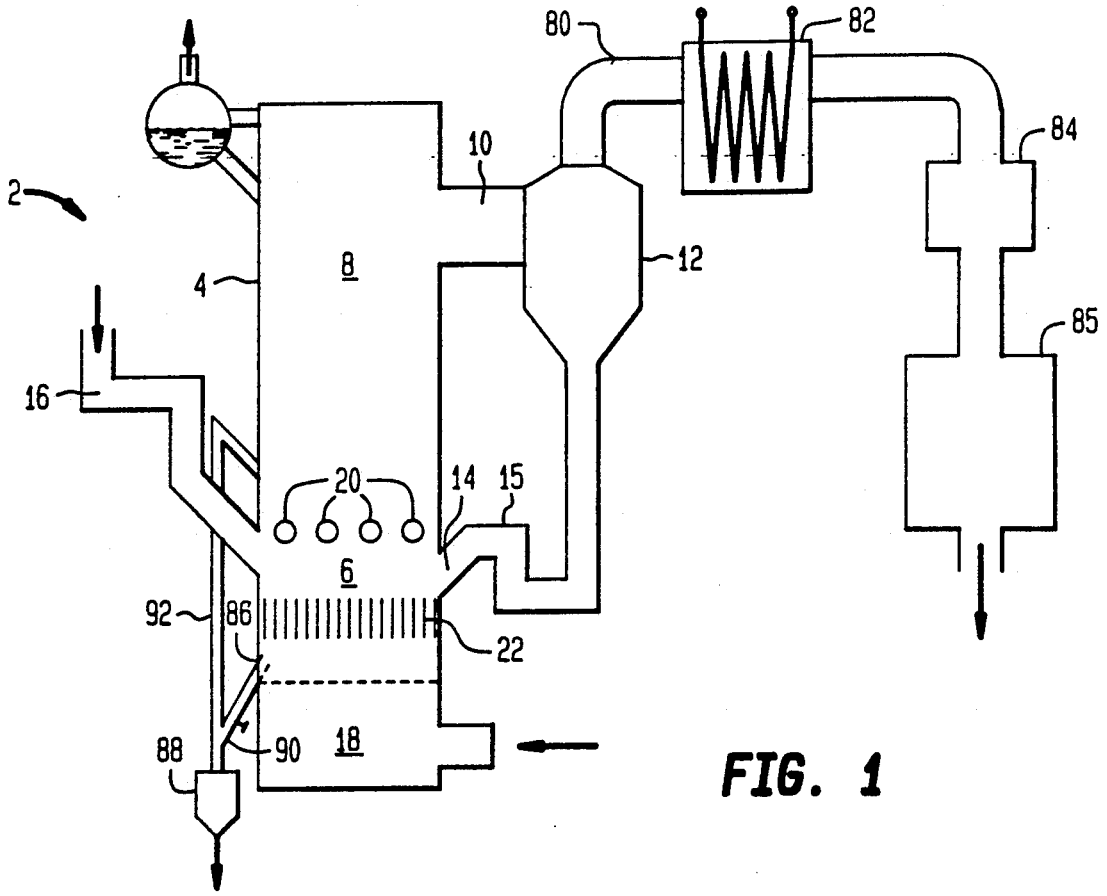
FIG. 1 is a schematic representation illustrating a bubbling fluid bed steam generator system in accordance with the present invention.

The invention can best be described by referring to the attached drawings wherein FIG. 1 depicts a bubbling fluid bed steam generator 2 comprising: a reactor chamber 4 having a lower combustion region 6 and a freeboard region 8; heat exchange means (not shown) for the circulation of a coolant disposed substantially throughout the freeboard region and along the walls of reactor chamber 4; discharge conduit 10 disposed near the top of reactor chamber 4 for the discharge of flue gas containing entrained solid particles therein; a particle separator 12 connected to discharge conduit 10 for separating the solid particles from the discharged flue gas, the solid particles being returned to lower combustion region 6 via a recycle port 14; chute 16 for introducing a carbonaceous material to lower combustion region 6; primary inlet means 18 for introducing a fluidizing gas disposed at the bottom of reactor chamber 4; and secondary inlet means 20 for introducing a fluidizing gas disposed above recycle port 14.

The bubbling fluid bed steam generator 2 also comprises a conduit 80 for removing flue gas from particle separator 12, conduit 80 being connected to a superheater 82, economizer 84, and air heater 85. Optionally, a boilerbank may be disposed between conduit 80 and superheater 82. A bed drain port 86 may be placed about lower combustion region 6 for removing bed material therefrom. Bed drain port 86 is preferably connected to an ash classifier 88 via a bed drain conduit 90. Ash classifier 88 is capable of separating fines from the coarse fraction of bed material, disposing of the coarse fraction and returning the fines to reactor chamber 4 via conduit 92. As an alternative, the device 88 may be a fluid bed ash cooler suitable for cooling high ash fuel ash quantities.

In the preferred embodiment, lower combustion region 6 has at least three dense bed zones and wherein at least the zones positioned nearest to the sidewalls of reactor chamber 4 have heat exchange means 22 disposed therein. As demonstrated in FIG. 2, lower combustion region 6 includes a combustion zone 30 disposed between a first heat transfer zone 32 and a second heat transfer zone 34. Each of the heat transfer zones (32, 34) have heat exchange means 22 disposed therein. The heat transfer zones (32, 34) are separated from combustion zone 30 by means of internal wall members 36 and 38. The internal wall members (36, 38) are arranged within lower combustion region 6 so that an underflow solids channel or weir 40 is disposed between the bottom of the internal wall members (36, 38) and air distribution plate 47.

Heat exchange means or tubes 22 are positioned within the heat transfer zones (32, 34) as either horizontal or semi-horizontal tubes in a tight pitch, such as 4–8 inches from the front to the back of reactor chamber 4. One possibility is to dispose tubes 22 semi-horizontal (approximately 15°) taken out of the sidewall so that thermosyphon action will cause the water to circulate through tubes 22 by natural convection. Another is to use horizontal tubes which have the fluid forced through tubes 22 by a circulation pump. Alternatively, the horizontal tubes may be used for reheating steam as shown in the configuration in FIG. 6.

Primary fluidizing gas is introduced into the bottom of the reactor chamber through center air chamber 42, first side air chamber 44 and second side air chamber 46. In this manner the primary fluidizing gas introduced into the respective zones may be adjusted individually and thus the operation of the overall system can be better controlled. The primary fluidizing gas enters lower combustion region 6 via the respective air chambers and associated tuyeres 48. Further, lower secondary air is introduced into the reaction chamber about the surface level of the center fluid bed in combustion zone 30 and upper secondary air is introduced via ports 20 higher up the reactor chamber.

During normal operation of the bubbling fluid bed boiler a fluidizing gas is introduced into combustion zone 30 via center air chamber 42 while the side air chambers (44, 46) are shut off. Combustion zone 30 is heated to typically 800–1200° F. by means of overbed burners (not shown). When combustion zone 30 is hot, fuel is introduced through chute 16 and the temperature of combustion zone 30 is brought up to between 1500–1700° F. After combustion zone 30 is brought up to the desired operating temperature, usually about 1600° F., the heat transfer zones (32, 34) are fluidized by allowing primary fluidizing gas to enter side air chambers 44 and 46, respectively.

Combustion zone 30 is preferably operated at about 8–15 ft/sec and the heat transfer zones (32, 34) are operated at a much lower velocity, e.g., 2–6 ft/sec. Operating the heat transfer zones (32, 34) at such a velocity eliminates or reduces erosion of heat exchange tubes 22. It also permits solid particles to flow from the heat transfer zones (32, 34) underneath the internal wall members (36, 38) via channel 40 into combustion zone 30.

Fine particles are typically carried into freeboard region 8 by the addition of lower and/or upper secondary air. These fine particles are either carried out of reactor chamber 4 with the flue gas or move up the center of reactor chamber 4 and then traverse down the sidewalls into heat transfer zones 32 and 34. The circulation of fine solid fuel particles into heat transfer zones 32 and 34 causes a higher dense bed level, e.g., 4–5 feet, in the heat transfer zones (32, 34), rather than the 3 feet dense bed of combustion zone 30. The higher dense bed levels in the heat transfer zones (32, 34) causes solid particles to flow out from under channel 40 and into combustion zone 30. The rate of flow may be controlled by the volume of air permitted into side air chambers 44 and 46.

Moreover, by controlling the primary fluidizing gas which enters heat transfer zones 32 and 34, combustion zone 30 may be kept at an optimum operating temperature, e.g., 1600° F., so that the limestone reaction with the sulfur, and formation of $NO_x$ and CO is optimized during low loads.

Much of the finer particles are carried out of reactor chamber 4 with flue gases into particle separator 12, separated out of the flue gas and returned to lower combustion region 6 by means of a "J" valve or FluoSeal 15 (FluoSeal is a trademark of Dorr-Oliver Inc.). Particle separator 12 is preferably a cyclone, and more preferably a water-cooled cyclone. Recycle port 14 may be directed into combustion zone 30 or, alternatively, part of the recycled solids may be directed by means of a diverter plate (not shown) into heat transfer zones 32 and 34. As such, the solids circulating through heat transfer zones 32 and 34 are not only from natural circulation but also from particle separator 12. Diversion of recycled solids to heat transfer zones 32 and 34 also ensures that sufficient heat capacity is available for satisfactory heat transfer to tubes 22.

Heat exchange tubes 22 typically have high heat transfer, i.e., about 40–100 Btu/ft$^2$/hr° F., because of the fine solids returning from both particle separator 12 and along the sidewalls of reactor chamber 4. Because the heat transfer in tubes 22 is an order of magnitude higher than that experienced in the lean phase of freeboard region 8 much less heating surface is needed. The overall height of reactor chamber 4 may also be reduced due to the high rate of heat transfer in tubes 22 disposed in heat transfer zones 32 and 34.

Figure 2:
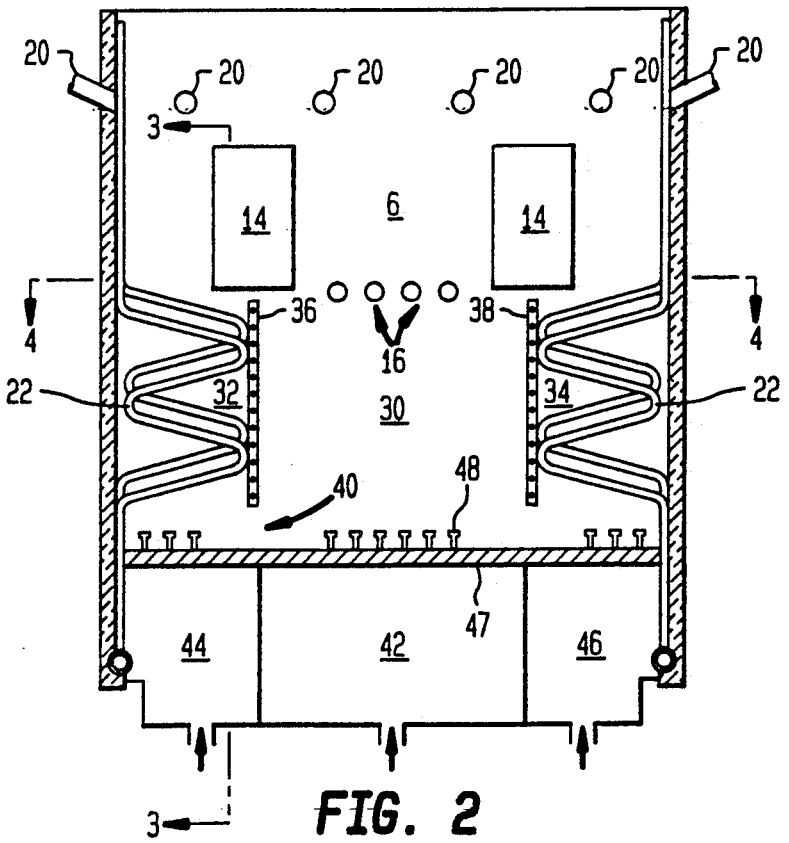
FIG. 2 is a cross-sectional view of the lower combustion region of the reactor chamber having a combustion zone and two heat transfer zones.

As shown in FIG. 2, the preferred embodiment of the bubbling fluid bed boiler includes a pair of particle separators (cyclones) connected to lower combustion region 6 via recycle ports 14. Utilization of a pair of cyclones permits the diverting of recycled solids to both heat transfer zones 32 and 34.

Since the solids velocity in freeboard region 8 is only about 13–17 ft/sec the lean phase solids in freeboard region 8 do not tend to erode the sidewalls or heat exchange tubes of the reactor. Furthermore, since the solids velocity in heat transfer zones 32 and 34 is only about 1–6 ft/sec tubes 22 also avoid erosion.

Figure 3:
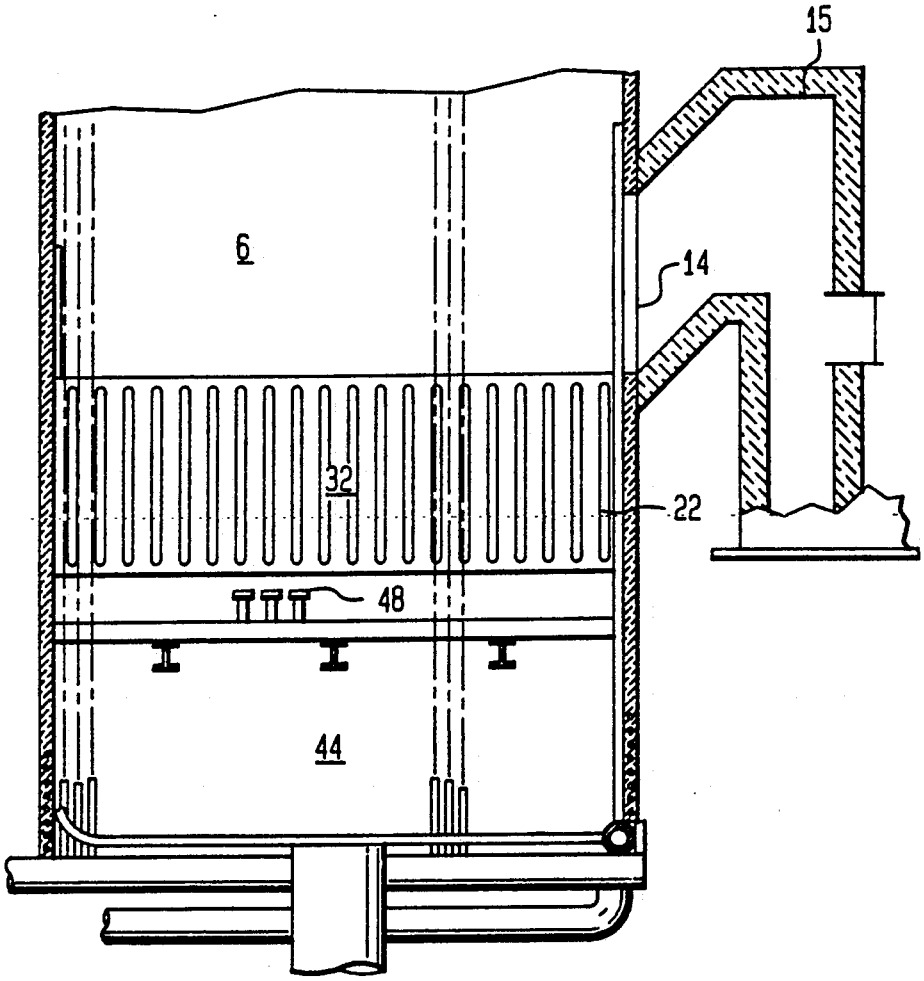
FIG. 3 is a cross-sectional view along line 3—3 of FIG. 2.
Figure 4:
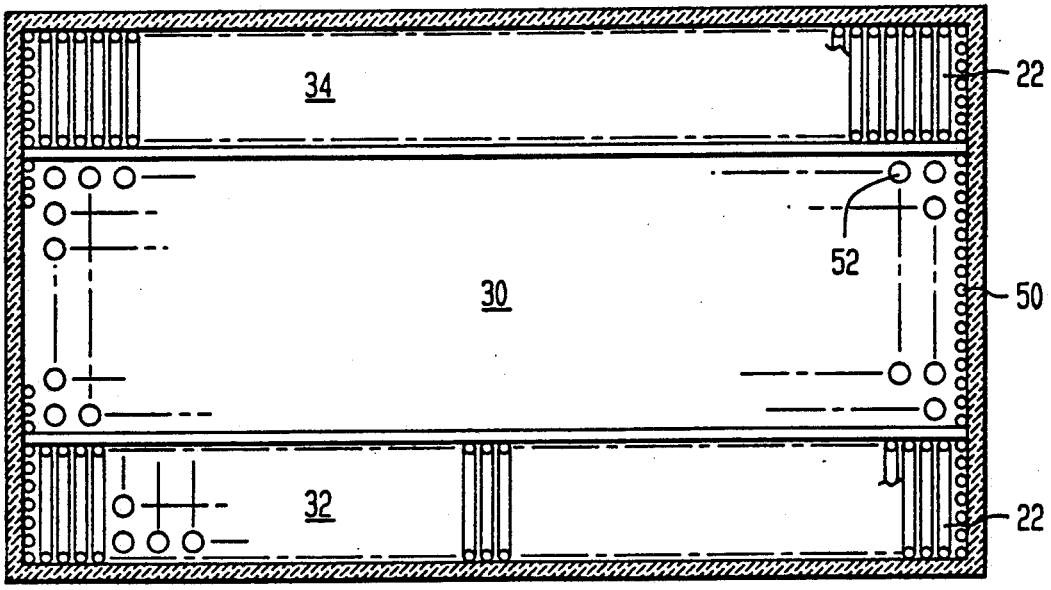
FIG. 4 is a top planar view along line 4—4 of FIG. 2.

FIG. 3 is a cross-sectional view along line 3—3 of FIG. 2 and depicts lower combustion region 6 having heat exchange tubes 22 disposed in heat transfer zone 32. Also shown is FluoSeal 15 connected to the reactor chamber at recycle port 14. FIG. 4 is a top planar view along line 4—4 of FIG. 2 and shows combustion zone 30 disposed between first heat transfer zone 32 and second heat transfer zone 34. Heat exchange tubes 50 are disposed about the sidewalls of the reactor chamber and heat exchange tubes 52 are internally disposed within the reactor chamber to effect additional heat transfer. Heat exchange tubes 22 are disposed semi-horizontally within both heat transfer zones 32 and 34. That is, heat exchange tubes 22 are taken out of the sidewalls so that thermosyphon action will cause the water to circulate throughout tubes 22 by natural convection.

Figure 5:
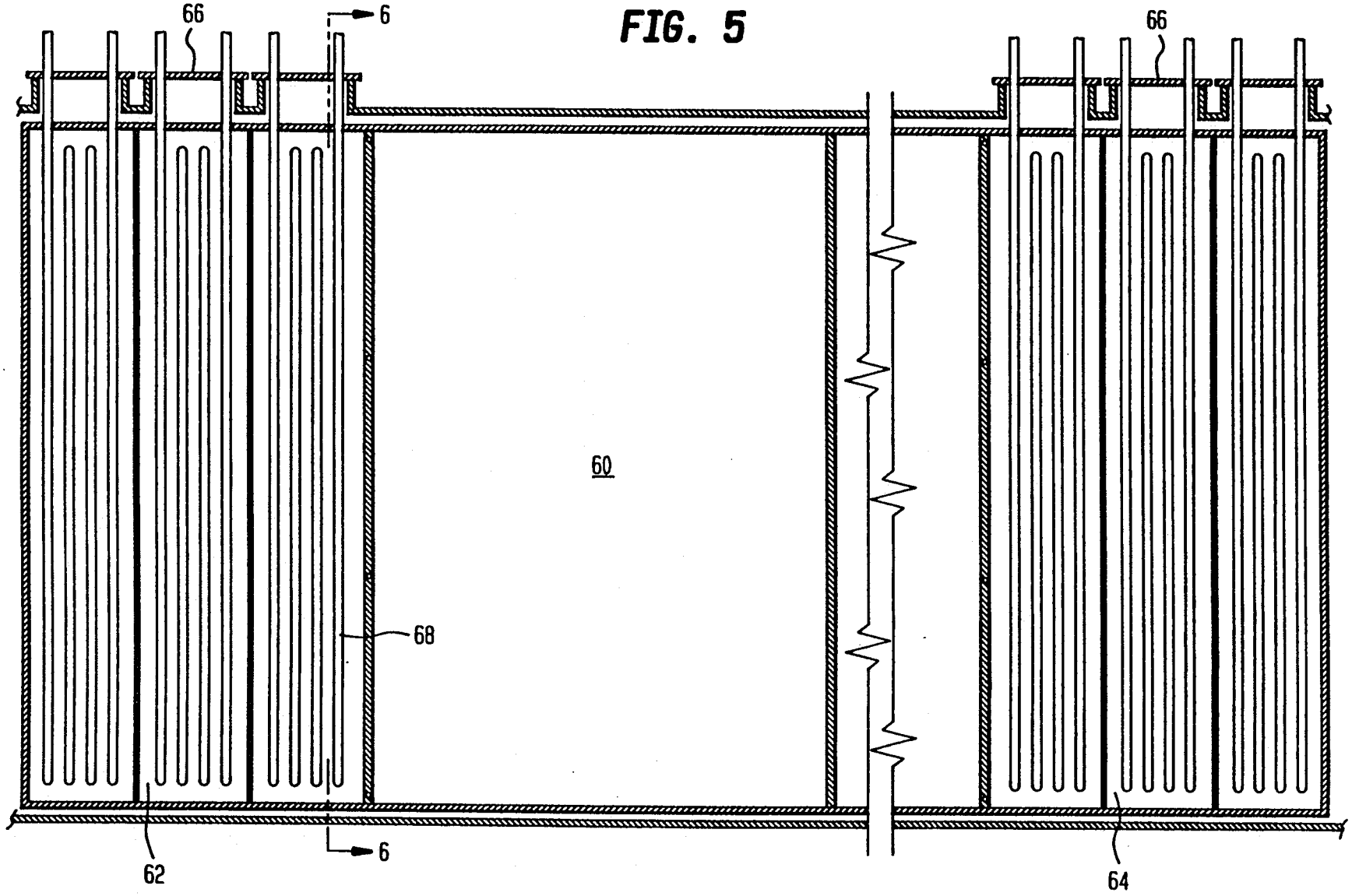
FIG. 5 is a top planar view of the multiple fluid bed zones having heat exchange tube disposed in the heat transfer zones thereof.
Figure 6:
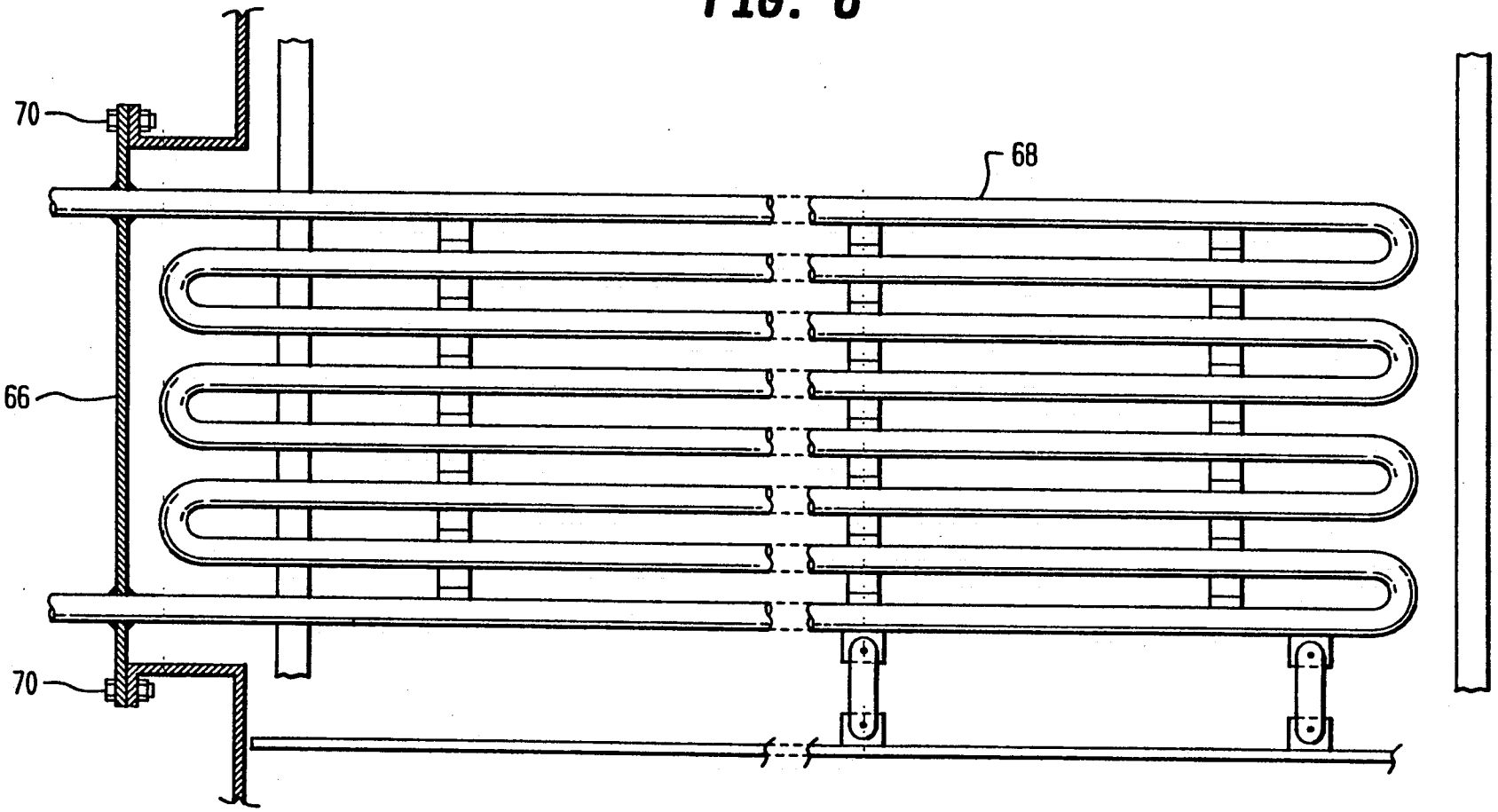
FIG. 6 is a cross-sectional view along line 6—6 of FIG. 5.

FIG. 5 is another embodiment of the present invention wherein combustion zone 60 is disposed between first heat transfer zone 62 and second heat transfer zone 64. The unique aspect of this embodiment is the application of heat exchange tube panels 66 having tubes 68 so as to provide increased operational control and maintenance access. The horizontal positioning of tubes 68 requires the use of a circulation pump to force water therethrough or may be cooled by superheated or reheated steam in which case a circulation pump is not required. FIG. 6 is a cross-sectional view along line 6—6 of FIG. 5 and depicts heat exchange tube panel 66 having heat exchange tubes 68. Panel 66 can be readily removed from the boiler by loosening bolts 70.

While I have shown and described several embodiments in accordance with my invention, it is to be clearly understood that the same are susceptible to numerous changes and modifications apparent to one skilled in the art. Therefore, I do not wish to be limited to the details shown and described but intend to cover all such changes and modifications which come within the scope of the appended claims.

What is claimed is:

1. A process for burning carbonaceous material to generate steam which comprises the following steps:

introducing carbonaceous material to a lower combustion region of a reactor chamber of bubbling fluid bed boiler, said lower combustion region comprising: a combustion zone disposed between at least a first heat transfer zone and a second heat transfer zone, wherein the zones are formed by at least two substantially vertical internal wall members disposed within said lower combustion region such that one internal wall member is disposed between said first heat transfer zone and said combustion zone, and another internal wall member is disposed between said second heat transfer zone and said combustion zone; said first and second heat transfer zones having heat exchange means disposed internally therein; and a means for individually controlling the fluidizing gas suppiied to each zone;

heating said combustion zone to a temperature in the range between about 800 to 1200° F. prior to introduction of said carbonaceous material;

fluidizing said carbonaceous material within said combustion zone with a primary fluidizing gas introduced at the bottom of said reactor chamber and a secondary fluidizing gas introduced into said reactor chamber at a level above said primary fluidizing gas, wherein the velocity of said combustion zone is in the range between about 8–17 ft/sec;

fluidizing said carbonaceous material within said heat transfer zones with a primary fluidizing gas introduced at the bottom of said reactor chamber and a secondary fluidizing gas introduced into said reactor chamber at a level above said primary fluidizing bas when the temperature of said combustion zone is between about 1500 to 1700° F., wherein the velocity within said heat transfer zones is in the range between about 2–6 ft/sec such that the fines of said carbonaceous material are carried up the center of said reactor chamber and down the sidewalls into said heat transfer zones;

burning said carbonaceous material in said reactor chamber;

removing thermal energy from said reactor chamber by disposing heat exchange means substantially throughout the freeboard region and along the walls of said reactor chamber and also within said heat transfer zones, whereby water contained within said heat exchange means is heated to produce steam;

separating solid particles entrained in flue gas discharged by said reactor chamber; and returning the separated solid particles to said reactor chamber via a recycle port disposed in a sidewall of said reactor chamber.

2. The process according to claim 1, wherein the dense bed level of said combustion zone is about 3 feet and the dense bed level of said heat transfer zone is between about 4–6 feet.

3. The process according to claim 1, wherein at least a portion of said solid particles returned to said reactor chamber via said recycle port are diverted to said heat transfer zone.

4. The process according to claim 1, wherein said heat exchange means disposed in said heat transfer zone transfers heat in an amount of between about 40–100 Btu/ft$^2$/hr° F.

5. The process according to claim 1, wherein the velocity of the freeboard region of said reactor chamber is in the range between about 13–17 ft/sec.

6. The process according to claim 1, wherein the temperature of said combustion zone is adjusted by controlling said primary air introduced to said heat transfer zone.

7. The process according to claim 1, wherein a desulfurizing agent is also introduced into said reactor chamber.

8. The process according to claim 1, wherein at least the secondary fluidizing gas contains oxygen.

9. The process according to claim 1, wherein said secondary fluidizing gas is introduced into said reactor chamber via two secondary inlet means.

10. The process according to claim 1, wherein the pressure profile of said reactor chamber is discontinuous; thereby causing the formation of a dense bed in said lower combustion region and a dilute phase in the freeboard region.

11. The process according to claim 1, wherein said heat exchange means are heat exchange tubes containing water therein.

12. The process according to claim 1, wherein said solid particles entrained in said flue gas are separated by a cyclone.

13. The process according to claim 12, wherein said cyclone is a water-cooled cyclone.

* * * * *